US006789710B1

(12) United States Patent
Szatkowski

(10) Patent No.: US 6,789,710 B1
(45) Date of Patent: Sep. 14, 2004

(54) BODY CARRIED BABY SEAT

(75) Inventor: Arthur C. Szatkowski, Guilder Land, NY (US)

(73) Assignee: Arthur Szatkowski, St. Naples, FL (US)

( * ) Notice: Subject to any disclaimer, the term of this patent is extended or adjusted under 35 U.S.C. 154(b) by 0 days.

(21) Appl. No.: 10/612,581

(22) Filed: Jul. 3, 2003

(51) Int. Cl.[7] ..... A61G 1/00

(52) U.S. Cl. ..... 224/159; 224/664; 224/679; 297/4

(58) Field of Search ..... 297/4; 224/158, 224/159, 160, 161, 649, 664, 679

(56) References Cited

U.S. PATENT DOCUMENTS 4,068,786 A * 1/1978 Taniguchi ..... 224/577
4,901,898 A * 2/1990 Colombo et al. ..... 224/159
5,292,042 A * 3/1994 Yamaguchi et al. ..... 224/159
5,492,256 A * 2/1996 Ive ..... 224/159
5,641,101 A * 6/1997 Nakayama ..... 224/159
D393,363 S * 4/1998 Kataoka ..... D3/215
6,186,381 B1 * 2/2001 Kernkamp ..... 224/161

* cited by examiner

*Primary Examiner*—Peter R. Brown

(57) ABSTRACT

The baby seat of the invention is a container which is carried by a person at a midriff location of the body. The baby seat consists of a rigid container that is inserted into another container attached to a belt of the person. The container has a seating plate removably attached to the rigid container. The seating plate consists of three parts. One part is attached to the rigid container, a second part performs as a seating plate for the baby and a third part limits the movement of the baby on the second part. All three parts are hinged to each other so that they can be collapsed into a single and flat unit which may be stored in a pocket on the container.

6 Claims, 8 Drawing Sheets

BODY CARRIED BABY SEAT

CROSS REFERENCES TO RELATED APPLICATIONS (none)

STATEMENT REGARDING FED SPONSORED R & D (none)

BACKGROUND OF THE INVENTION

This invention relates to the art of carrying a baby in one's arms. This is an old tested and experienced task that have exasperated many parents, young or old, male or female, carrying a baby involves shifting the person's posture because in balancing the baby in one's arms involves readjusting the weight of the upper torso of the carrier to compensate for the weight of the Baby. The person carrying the baby has to adjust the upper torso backward relative to the lower torso. This adjusting involves moving the spine of the person backward over the vertical line of the lower torso.

BRIEF SUMMARY AND OBJECTS OF THE INVENTION

An object of the invention is to readjust the posture of the person carrying a baby in his or her arms. This is accomplished by carrying a seat for the baby on the midsection of a person whereby the weight of the baby is taken away from the upper torso of the person without having to change the posture of the person and to keep the posture in a normal and healthy position. In this manner, the weight of the Baby is distributed around the mid section of the person without disturbing the spine of the person and without having to assume an unnatural position. The natural posture of the person remains undisturbed, which makes it much easier to carry a baby on one's person and for a much longer time without fatigue or distortion.

DETAILED DESCRIPTION OF THE INVENTION

Figure 1:
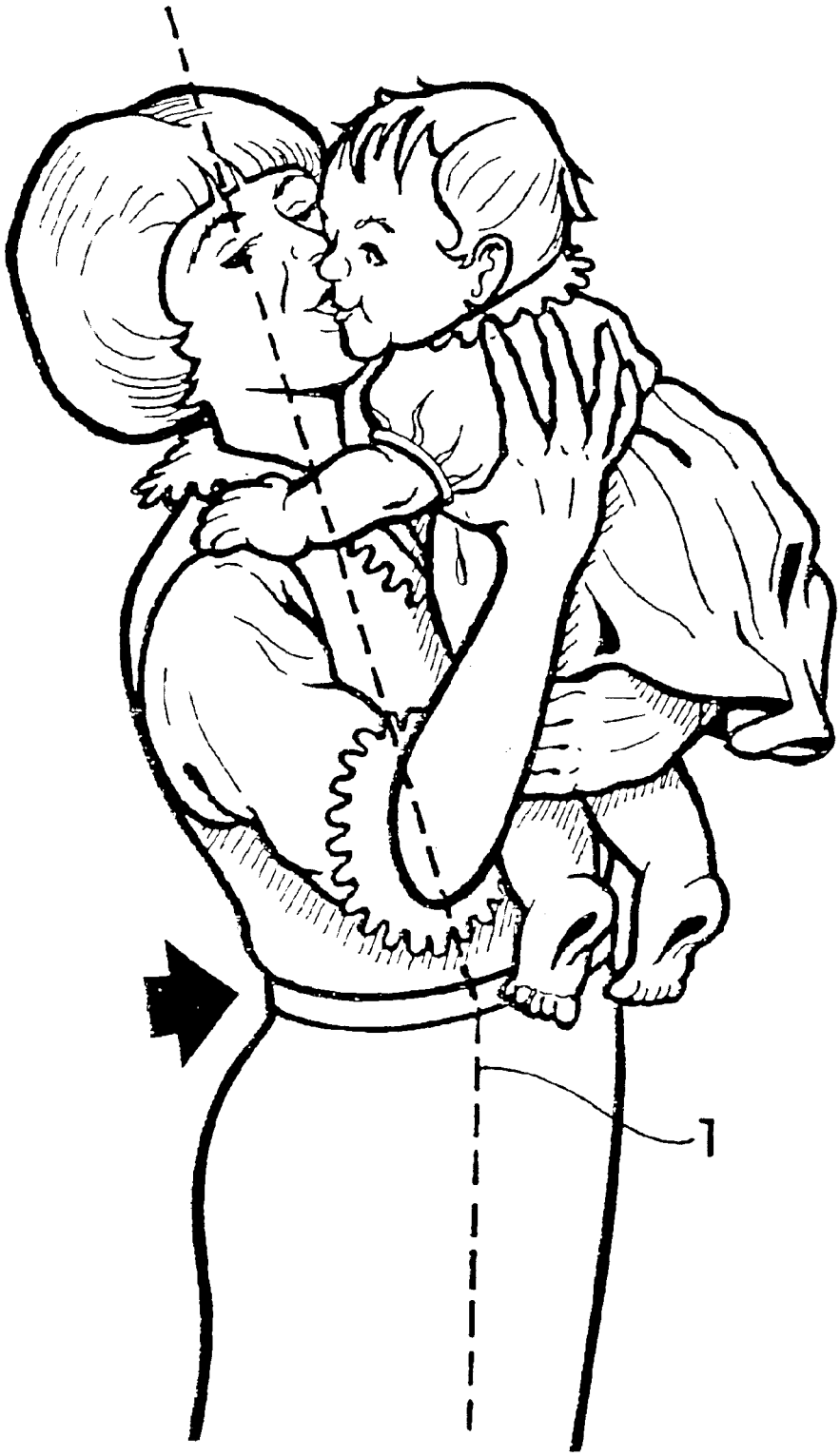
FIG. 1 is a prior art or way demonstration of carrying a baby.

In FIG. 1, identified as prior art, the person carrying a baby in a known or well established manner, exhibits the misalleged center of gravitation. That is the line of gravitation 1 is not aligned in the torso. With other words, the line is leaning backward. This will misalign the torso of the wearer including the spine after a prolonged period of time.

Figure 2:
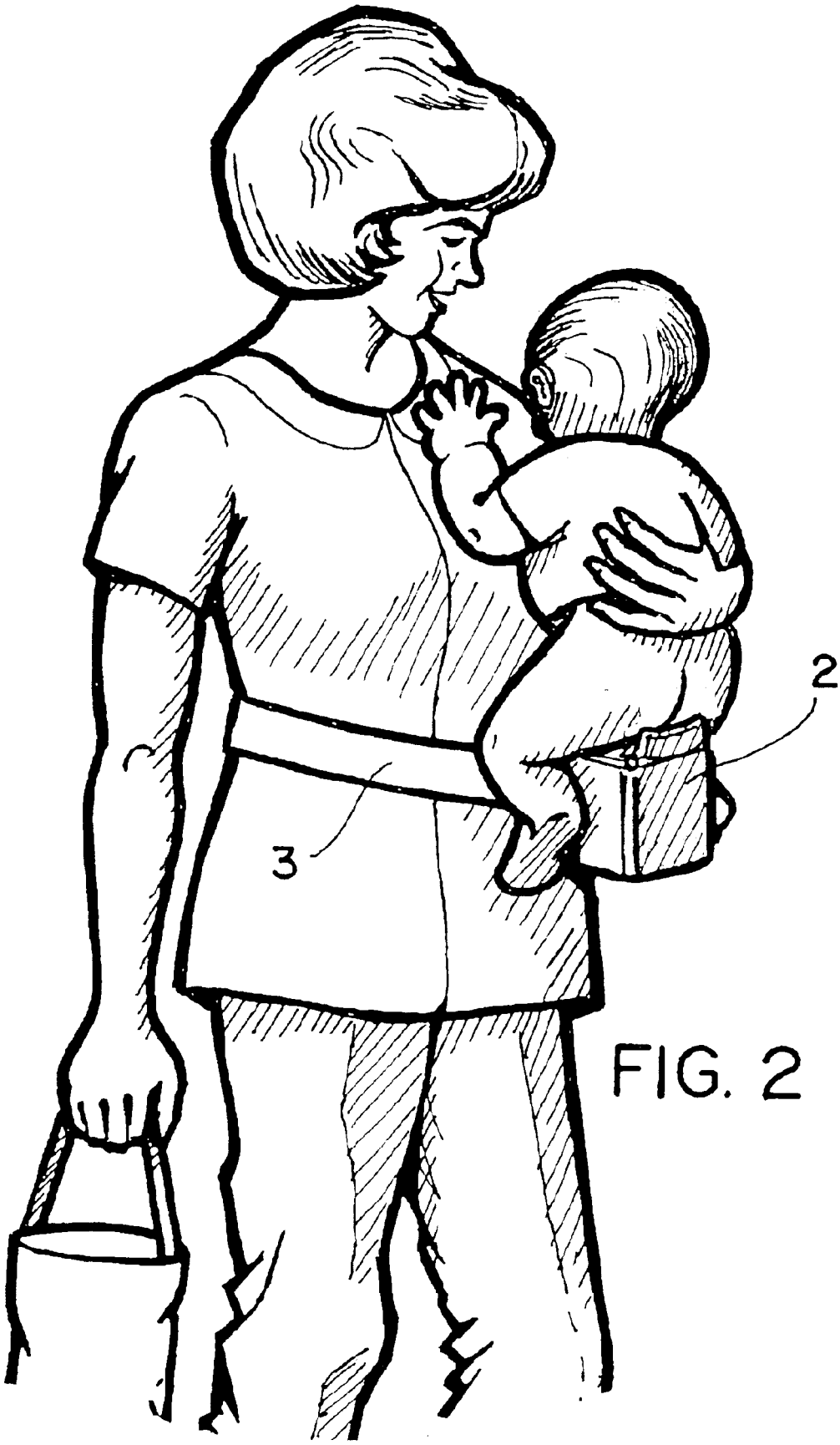
FIG. 2 shows a demonstration of carrying a baby according to the invention.

FIG. 2 demonstrates the advantage of this invention in that the person, carrying the baby, is in a straight posture of the body, simply, the baby is not carried on the back of the person but is sitting on a baby seat which is connected to a belt in the midsection of the person. It can clearly be seen from the FIG. 2 that the person carrying the baby has taken a natural posture, that is straight.

Figure 3:
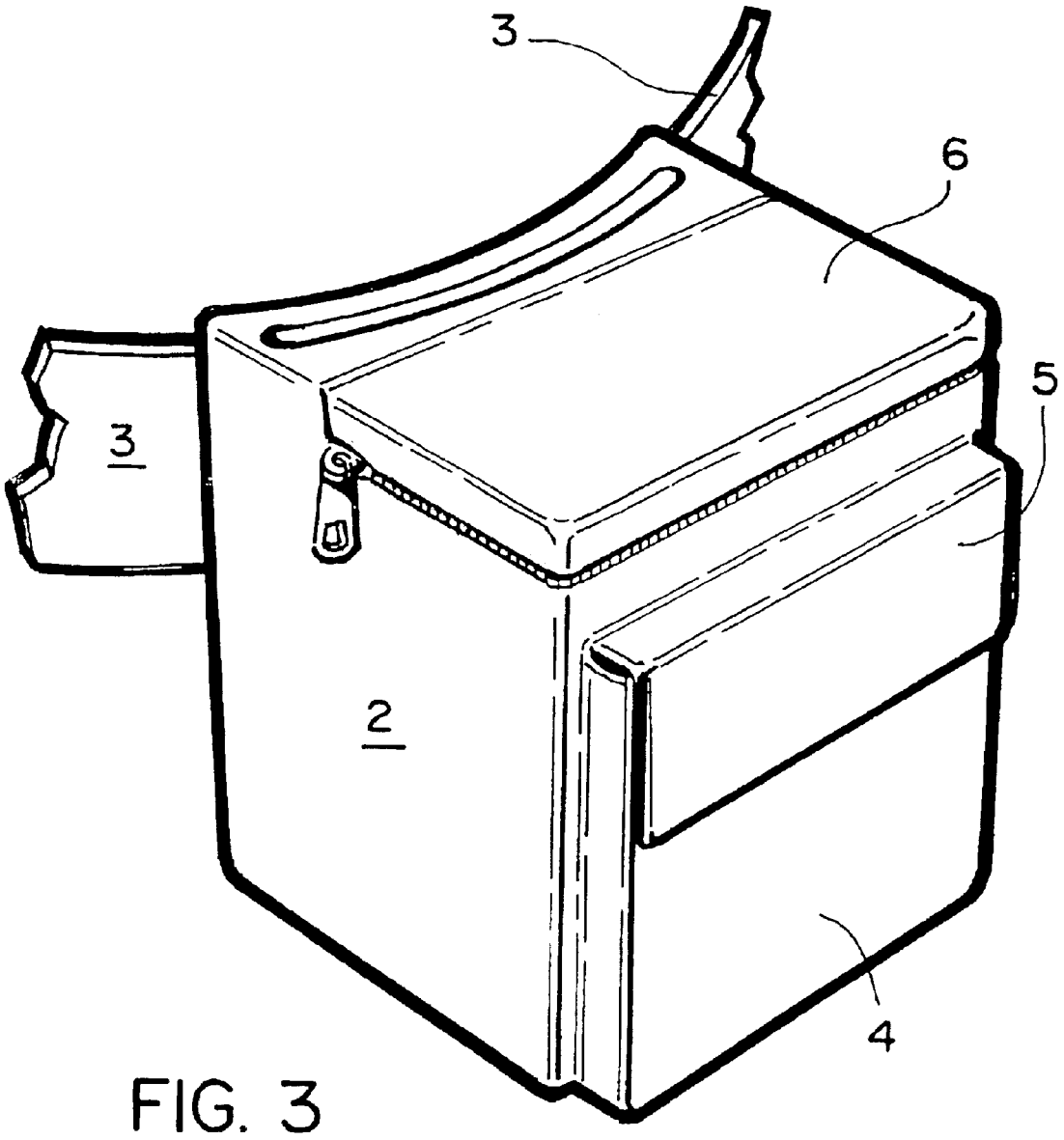
FIG. 3 shows the inventive seat as it is attached to a belt of a person.

FIG. 3 shows the container 2 installed on a belt 3 on a person in a ready position to perform several functions, that is, as a container or as a baby seat when converted.

The belt 3 holds the container on a person. The top of the container or the box 2 has a top closure cover 6 which can be opened or closed. The container 2 also has a front container 4 with a closure cover 5 that may contain any item including a seat 11 section (FIG. 5).

Figure 4:
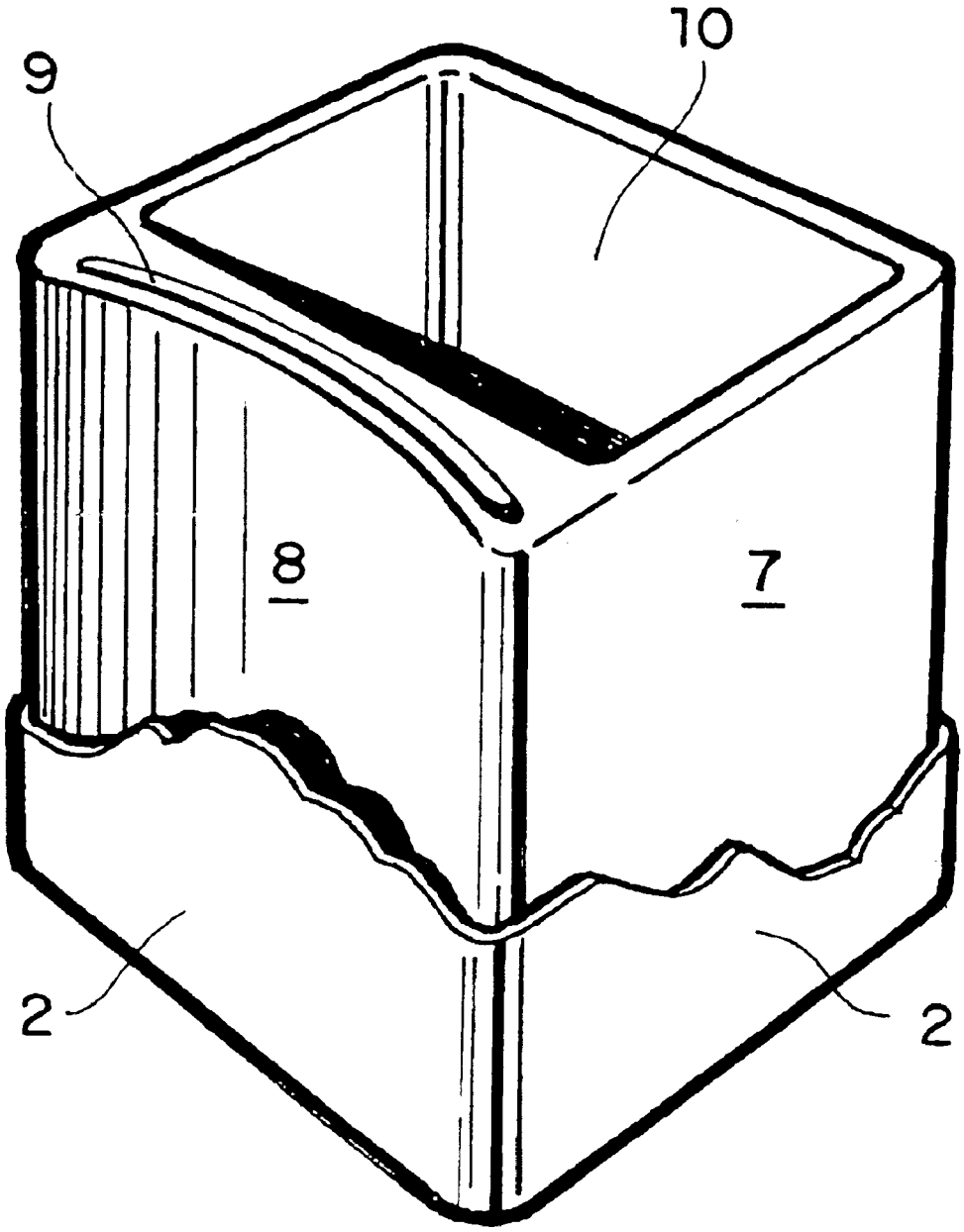
FIG. 4 illustrates the bay seat as a container.

FIG. 4 shows a container 7 that is contained within the baby seat overall container 2. The container 7 should be made of a rigid material to hold its shape when a baby is seated on top of the same. The container 7 includes a curved side 8 which, when carried on a body of a person will conform to the shape of the body and will not interfere therewith. The interior 10 of the container 7 can be used to store any items such as baby clothes, water or milk bottles.

Figure 5:
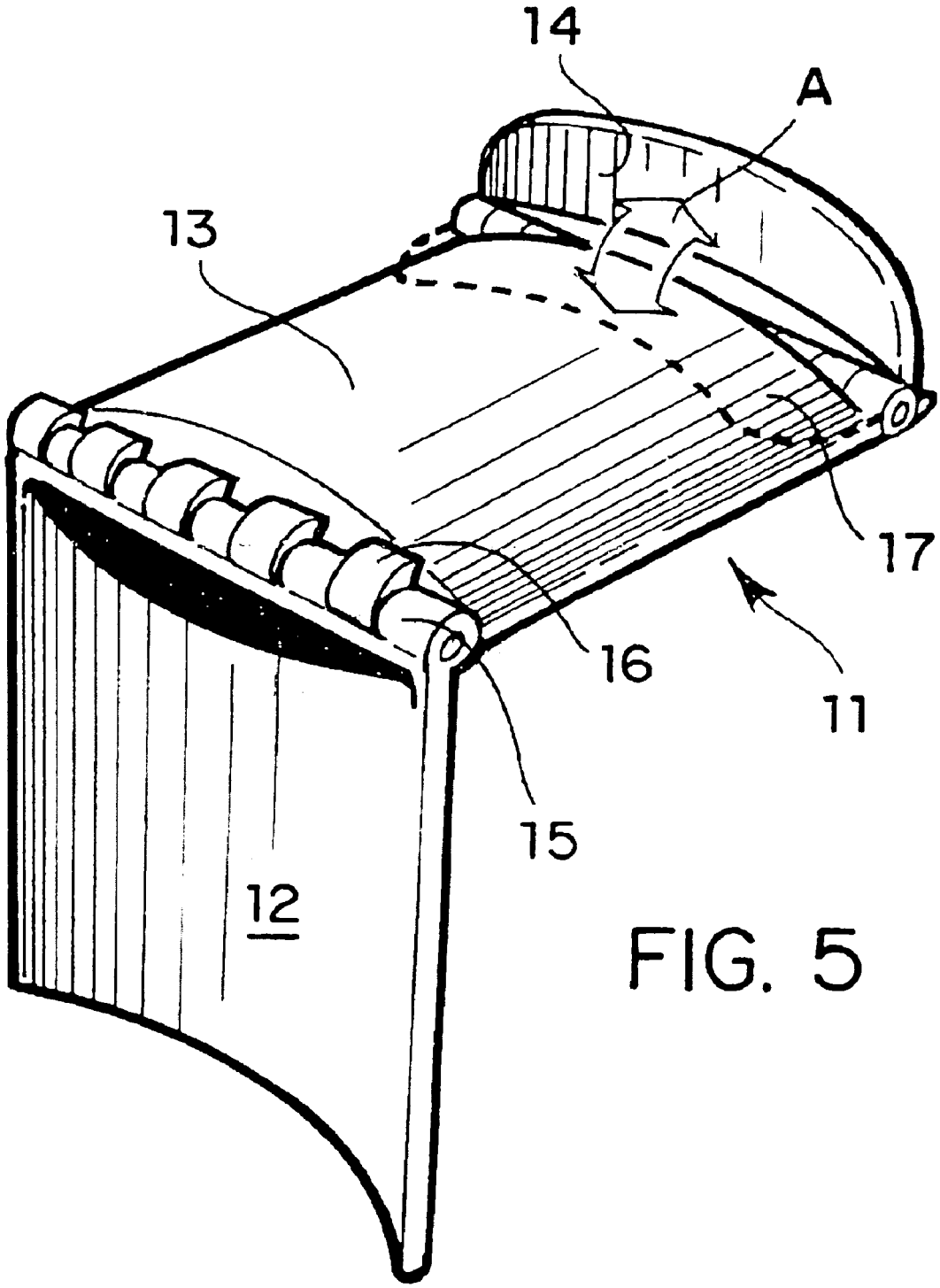
FIG. 5 shows a conversion kit to convert from a container to a baby seat.

FIG. 5 shows a perspective view of the baby seat 11 that will be placed over the open container 7 (FIG. 4). When not in use, the collapsed seat may be stored in the forward pocket 4 (FIG. 3). The seat 11 has several parts that are hinged together. There is a curved plate 12 which is fitted into the curved receptacle 9 (FIG. 4) to obtain a rigid connection with the container 7. This plate 12 remains in a substantial vertical position when in use. At the upper end of plate 12 there is hinge 15 which connects with a seating plate 13 for the baby. The hinge 15 has a seat limiter which prevents the hinge 15 and thereby the seating plate 13 from opening at an angle of more than 90°. This feature again contributes to the overall rigidity of the baby seat when in use. At the forward end of the seating plate 13 there is located an upstanding seat limiter 14, which, when in this position, prevents the baby seated on the seating plate from sliding off the end of the seating plate 13. This is an important safety feature of this invention. The seat limiter 14 is hinged to the seating plate 13 in such a manner so that it cannot rotate (arrow A) more than 90° relative to the seating plate 13. However, when not in use, the seat limiter 14 can only be rotated into a collapsed and folded-up condition 17.

Figure 8:
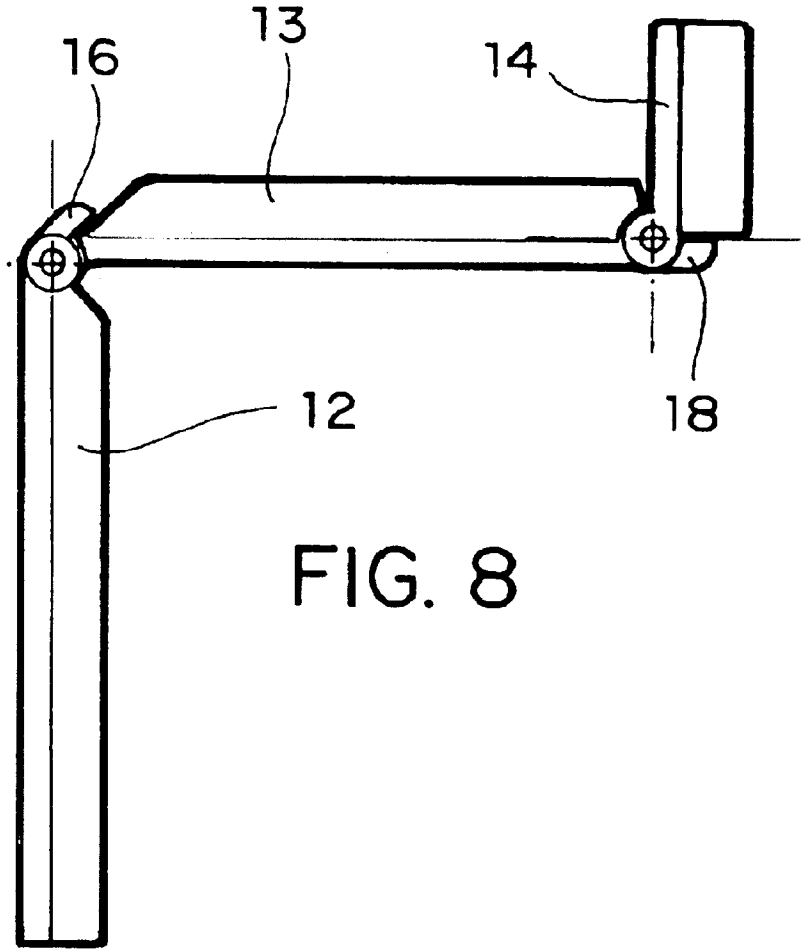
FIGS. 6-8 show the conversion kit as it is being deployed.
Figure 7:
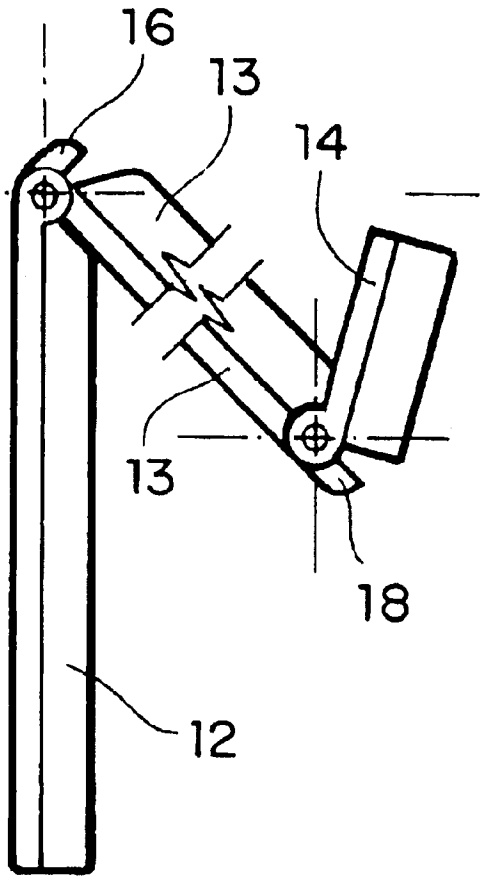
Figure 6:
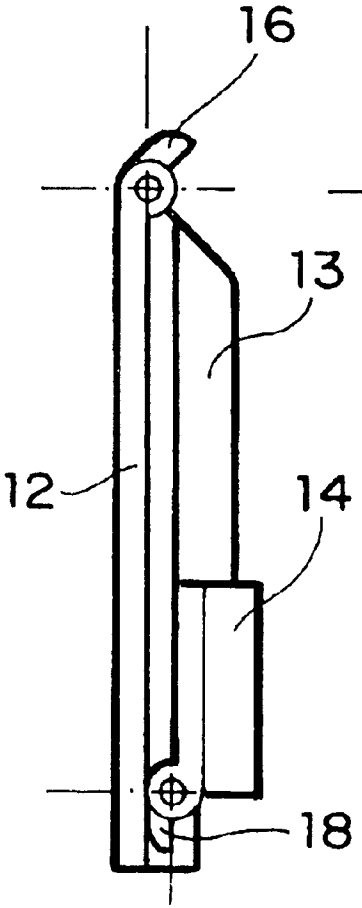

FIGS. 6-8 demonstrate the sequence of folding and unfolding the seat limiter 11 for storage or for use. It is clear from this sequence how the hinge limiters operate. For example, the seat limiter plate 14 can only rotate forward because of the presence of the protrusion 18 within the hinge that rotates the seat limiter plate 14. The same hinge limiter 16 is shown in combination with the hinge 15. It is believed that the sequence of folding and unfolding of the seating plate 13 is self-explanatory by observing FIGS. 6-8.

Figure 9:
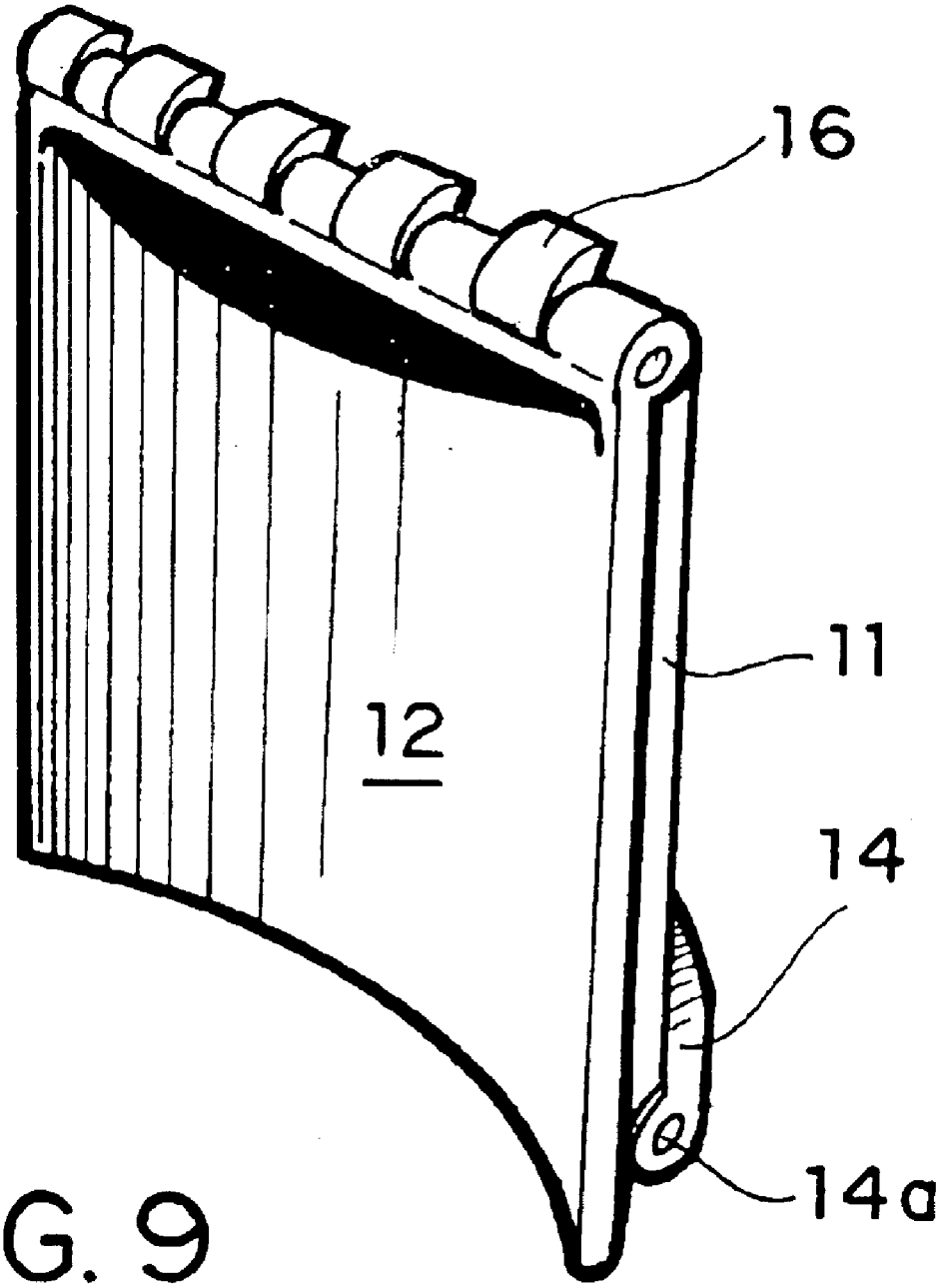
FIG. 9 shows the conversion kit in a collapsed position.

FIG. 9 shows the seating plate 11 in a completely collapsed condition and it is ready for storage. To this end, the collapsed seating plate 11 may now be stored in the compartment or pocket 4 as is shown in FIG. 3.

Figure 10:
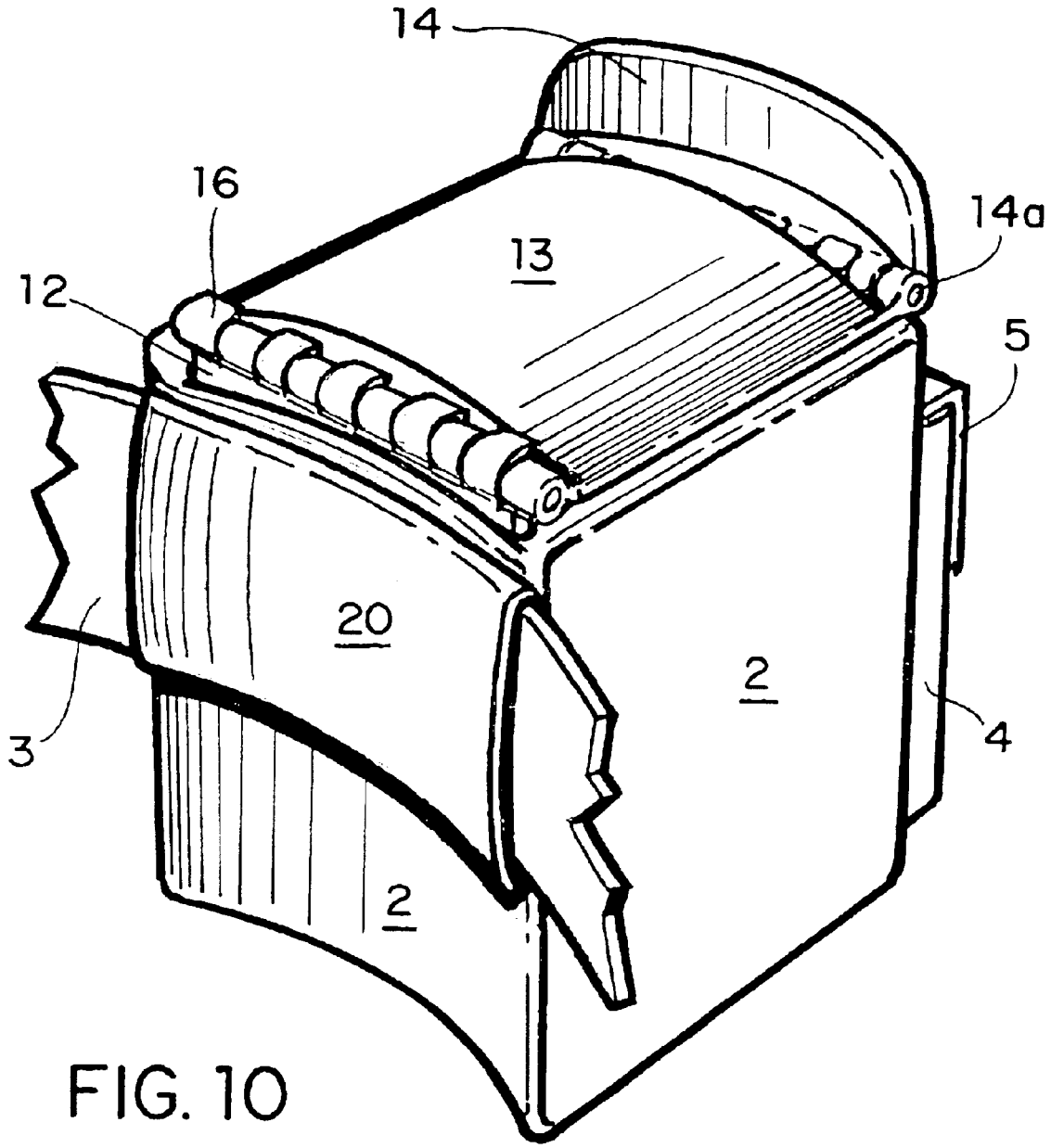
FIG. 10 shows the baby seat fully assembled and installed on a belt.

FIG. 10 shows the bay seat in a fully deployed condition. The back of the container 2 has a loop 20 attached thereto which loop would receive the belt of a wearer so that the container and thereby the seat for the baby can be attached and worn at the midriff of a wearer From all of the above it can be seen that the inventive concept greatly contributes to the care, especially, the handling of babies, especially while in transit.

What I claim is:

1. A baby seat adapted to be worn at a midriff position of a person carrying said baby, said baby seat including a first flexible container having means for attaching said first flexible container to a belt of said person, said first flexible container receiving and holding a second rigid container, said second rigid container having an open interior, said open interior is covered by a seating plate, said seating plate is a seat for a baby to be sitting thereon, whereby the weight of the baby is carried by said second rigid container and thereby by said person at said midriff location, and wherein said seating plate is stored in a pocket on said first flexible container when not in use.

2. The baby seat of claim 1, wherein said seating plate consists of three parts, a first part being a plate which is received in a vertical curved receptacle in a rear of said rigid container, a second part forming a seat for a baby to sit on and third is an upstanding plate limiting the extent of movement of the baby sitting on said seat.

3. The baby seat of claim 2, wherein all three parts are foldable relative to each other to form a single flat unit.

4. The baby seat of claim 2 including means for limiting the rotational movement of said parts relative to each other to a certain extent.

5. The baby seat of claim 1 including means for closing a top of said first flexible container.

6. The bay seat of claim 1 including means for closing said pocket.

* * * * *